US007418805B2

(12) United States Patent
Tan

(10) Patent No.: US 7,418,805 B2
(45) Date of Patent: Sep. 2, 2008

(54) MODULAR FRAMING SYSTEM AND A METHOD OF CONSTRUCTION THEREOF

(75) Inventor: Chee Peng Tan, Kuala Lumpur (MY)

(73) Assignee: Quantum Linkage SDN BHD, Kuala Lumper (MY)

( * ) Notice: Subject to any disclaimer, the term of this patent is extended or adjusted under 35 U.S.C. 154(b) by 491 days.

(21) Appl. No.: 11/185,309

(22) Filed: Jul. 20, 2005

(65) Prior Publication Data

US 2006/0016151 A1 Jan. 26, 2006

(30) Foreign Application Priority Data

Jul. 21, 2004 (MY) ..... PI 20042916

(51) Int. Cl.
*E04B 2/00* (2006.01)

(52) U.S. Cl. ..... 52/582.2; 52/578; 52/234; 52/481.1

(58) Field of Classification Search ..... 52/582.2, 52/564, 654, 656.1, 656.5, 656.6, 656.7, 52/204.1, 204.5, 127.1, 127.8, 239, 474, 52/481.1, 766, 772, 773, 582.1, 786.1, 591.4, 52/591.5, 774, 775, 586.1, 586.2
See application file for complete search history.

(56) References Cited

U.S. PATENT DOCUMENTS 2,414,060 A * 1/1947 Rausch ..... 403/219
2,453,221 A * 11/1948 Haden ..... 52/461
3,348,459 A 10/1967 Harvey
3,512,819 A * 5/1970 Gillingwater et al. ..... 52/461
3,640,039 A * 2/1972 McKee et al. ..... 52/281
4,103,465 A * 8/1978 McDonald, Jr. ..... 52/127.12
4,953,338 A 9/1990 Wilson et al.
5,058,333 A * 10/1991 Schwartz ..... 52/73
5,179,810 A * 1/1993 Gename et al. ..... 52/240
5,970,675 A * 10/1999 Schray ..... 52/582.1
6,282,849 B1 9/2001 Tuczek
6,962,025 B1 * 11/2005 Hill ..... 52/396.04
7,194,844 B2 * 3/2007 Dennis ..... 52/582.1
2004/0244317 A1 12/2004 Peng

FOREIGN PATENT DOCUMENTS

FR 2 722 812 A1 1/1996

* cited by examiner

*Primary Examiner*—Richard E. Chilcot, Jr.
*Assistant Examiner*—Anthony N Bartosik
(74) *Attorney, Agent, or Firm*—Wolf, Greenfield & Sacks, P.C.

(57) ABSTRACT

The present invention discloses a method of constructing a modular framing system where orthogonal frames are arranged adjacent to one another with their corresponding edges positioned next to one another. Each frame is formed from two horizontal and two vertical frame elements. A plurality of locks is inter-disposed between the adjacent vertical frame elements, each with a frame slot. At least two locks are double-locking type, one inter-disposed between the top sections of the vertical frame elements and the other between the bottom sections of the vertical frame elements. A plurality of locks is single-locking type, which is equi-distantly installed along the length of one vertical frame element in between the two double locks. The double locks lock both adjacent vertical frame elements. One side of the single locks lock only one vertical frame element and the other side inserts into the frame slot of the adjacent vertical frame element.

4 Claims, 8 Drawing Sheets

MODULAR FRAMING SYSTEM AND A METHOD OF CONSTRUCTION THEREOF

RELATED APPLICATIONS

Foreign priority benefit is claimed under 35 U.S.C. §119 (a)-(d) or 35 U.S.C. §365(b) of Malaysian application number PI 2004 2916 filed Jul. 21, 2004 which is hereby incorporated by reference.

TECHNICAL FIELD

This invention relates generally to improvements to a modular framing system and a method of construction thereof. Specifically, this invention relates to a particular frame slot design profile of a frame element to engage a plurality of double locks and single locks in mating two adjacent frames or structures.

BACKGROUND OF THE INVENTION

Modular frames are frequently used to form structural components in the construction of booths, rooms and display panels at marketing events, conventions and general events, including modular partitions, frames fixed with transparent materials, display panels and raised platform structures.

In an earlier Malaysian Patent Application Number PI 20032116, the invention discloses a modular framing system and a method of construction thereof. Single frames or stacks of adjacent frames are interconnected by elongate locks positioned between said frames. Adjacent frames can either be connected together with one elongate lock or a plurality of elongate locks joined by lock connectors to form a continual length of elongate locks. The number and length of the elongate locks to be used are dependent on the height of the frames to be used and the distance between the top frame and the underside of a room ceiling.

Each frame is made up from two horizontally disposed and two vertically disposed frame elements. Each frame element has a frame slot that interlocks with the elongate locks to connect the adjacent frames to form an assembly of frames. Each elongate lock is designed to slidably fit the frame slots provided on the frame elements.

The main disadvantage of the previous invention is that a single elongate lock or a plurality of elongate locks is used to make up the length of the frame. Where the frame is lengthy, such as more than 2 meters long, this leads to the practical problems of installation on site.

The previous invention also disclosed three specific designs of the elongate lock. In a first embodiment, the elongate lock assumes an I-shaped channel with two lateral flanges and a lengthwise web. The undersides of the lateral flanges are turned inwardly to form two lock slots with the lengthwise web. Each lock slot defines a narrow entrance, an enlarged interior section and a recessed portion. With this first embodiment, two frames or structures are disposed in the same plane. In a second embodiment, the elongate lock assumes an extruded component with two lock slots provided on its lengthwise body. The two frames or structures are disposed in perpendicular planes from each other. In a third embodiment, the elongate lock assumes an extruded component with three lock slots provided on its lengthwise body. The three frames or structures are disposed in perpendicular planes from one another.

Hence, this invention may be considered as a continuation of the above-mentioned patent application and certain improvement features are now disclosed to overcome some practical problems encountered in the implementation of the previous invention.

SUMMARY OF THE INVENTION

The primary object of the present invention is to allow tall wall structure or partitions to be constructed without horizontal joints, using adjacent single frames.

Another object of the invention is to allow tall wall structures or partitions to be constructed using adjacent single or stacks of frames, or a combination of both.

Still, another object of the invention is to provide a versatile modular framing system that is easily constructed and dismantled on site, even by unskilled workers.

Yet, another object of this invention is to provide a cost-effective modular framing system, since only two double locks are used.

The present invention discloses a modular framing system where single frames or structures or stacks of frames or structures are arranged in adjacent to one another with their corresponding edges positioned in close proximity to one another. Each frame is being formed from two horizontal and two vertical frame elements. To meet the above objects, a plurality of locks is inter-disposed between the adjacent vertical frame elements equipped with the frame slot design profile according to the invention. At least two locks are double-locking type, one inter-disposed between the top sections of the frame elements and the other between the bottom sections of the frame elements. A plurality of locks is single-locking type, which is equi-distantly installed along the length of the vertical frame elements in between the two double locks. The double locks lock both adjacent vertical frame elements. In the case of single locks, one side of the single locks locks one vertical frame element and the other side inserts into the frame slot of the adjacent vertical frame element.

A method of constructing a modular framing system is also disclosed. At least two double locks and a plurality of single locks are employed to lock two adjacent vertical frame elements. A plurality of single locks is employed to lock two adjacent horizontal frame elements.

BRIEF DESCRIPTION OF THE DRAWINGS

The following description of the drawings is intended to facilitate a better understanding of the invention.

DETAILED DESCRIPTION

Figure 1:
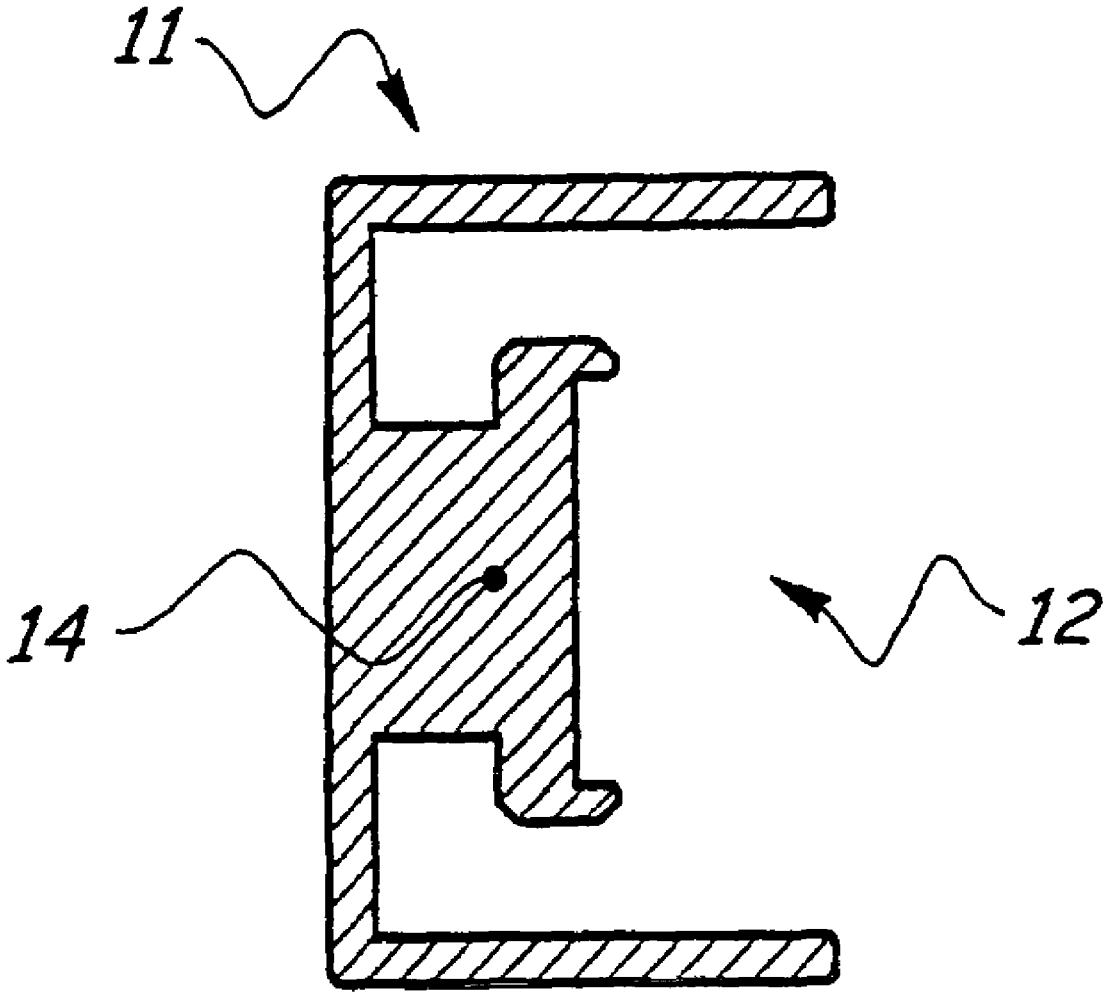
FIG. 1 shows the profile of a single frame slot, separately extruded, according to the invention.

For the ease of explanation, the following description refers to two adjacent vertical frame elements (11) placed in the same plane. It should be understood that the description is also applicable to adjacent horizontal frame elements (11) on the same plane.

For the sake of clarity, alphabets "a" and "b" are used to differentiate similar parts or components.

Two adjacent left and right single frames (1*a*, 1*b*) are assembled or fitted together using at least two double locks (2) and a plurality of single locks (3), engaging frame slots (12*a*, 12*b*) of two mating vertical frame elements (11*a*, 11*b*). Each frame (1) is made up of two horizontal and two vertical frame elements (11). In order for the locks (2, 3) to work, each frame element (11) carries a frame slot (12) that engages the locks (2, 3).

There are various configurations and designs for the frame element (11), but the design profile for the frame slot (12) remains essentially the same. A lock guide (14) with an enlarged head is integrally disposed inside a U-shaped channel, making up a single frame slot (12) separately extruded, as shown in FIG. 1. This design profile may be integrally attached to a box frame or other structural frame, even a wall, to make up as a frame element (11). In other words, the design profile of the frame slot (12) can assume the form of an extruded element and be used separately. In this situation, the invention then relates to attaching a frame (1) to a structure.

Figure 2A:
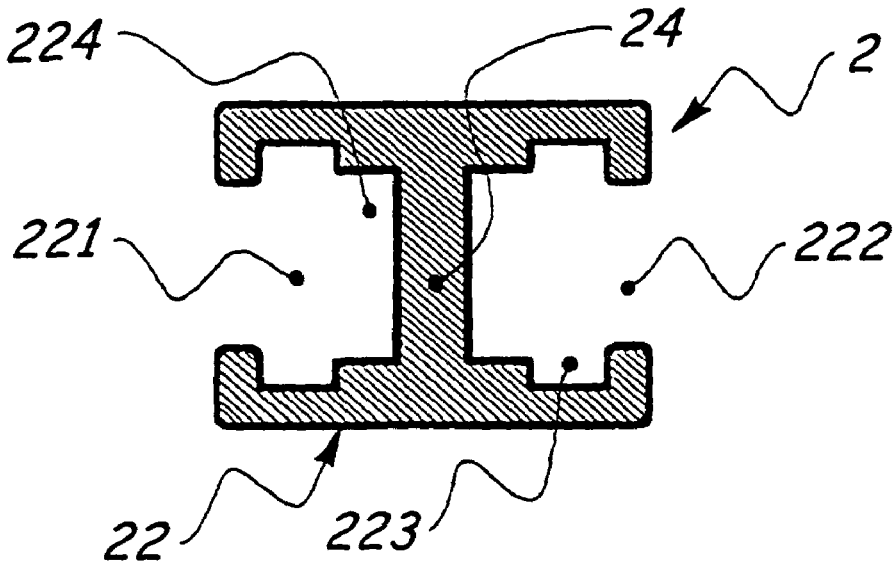
FIG. 2*a* shows a cross-section view of a double lock according to the invention.

FIG. 2*a* shows a cross-section view of the double lock (2) according to the invention. The double lock (2) is substantially an I-shaped channel with two lateral flanges (22) and a lengthwise web (24). The undersides on both sides of the lateral flanges (22) are turned inwardly to form two lock slots (221) with the lengthwise web (24). Each lock slot (221) defines a narrow entrance (222), an enlarged interior section (223) and a recessed portion (224). It is important to note that the double locks (2) are designed, such that they can be slid into the frame slots (12) on the frame elements (11).

Figure 2B:
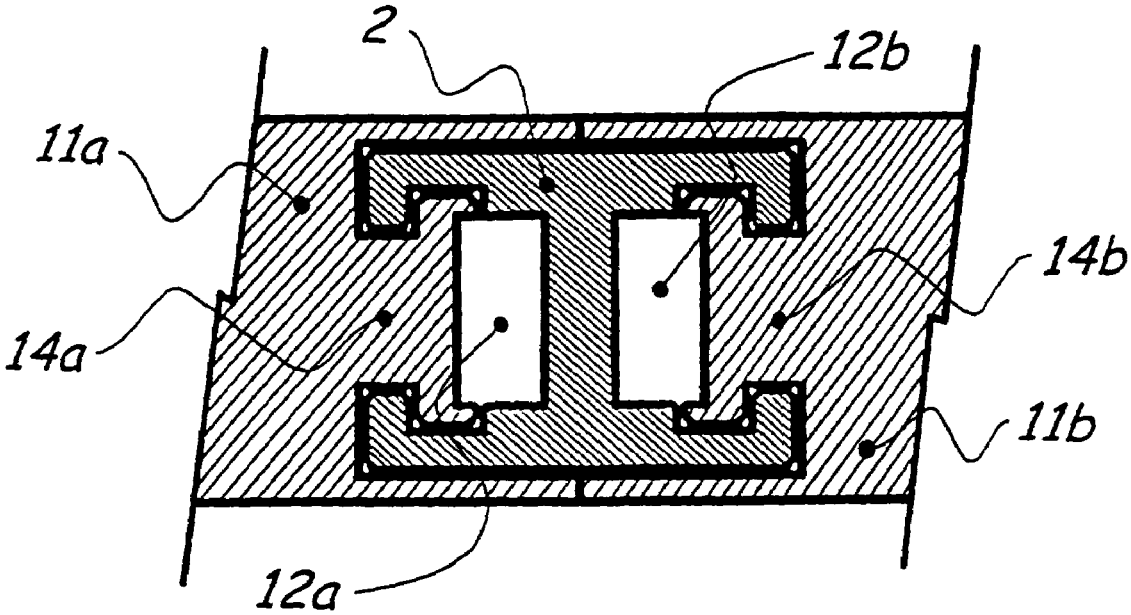
FIG. 2*b* shows a cross-section view indicating how the double lock of FIG. 2*a* being sandwiched between two frame slots of FIG. 1 of adjacent frame elements.

As seen in FIG. 2*b*, a double lock (2) is sandwiched between two vertical frame elements (11*a*, 11*b*). Each vertical frame element (11*a*, 11*b*) incorporates a frame slot (12*a*, 12*b*) with a lock guide (14*b*, 14*b*). The narrow entrance (222) and the enlarged interior section (223) of the lock slot (221) engage the lock guide (14) with an enlarged head.

Figure 2C:
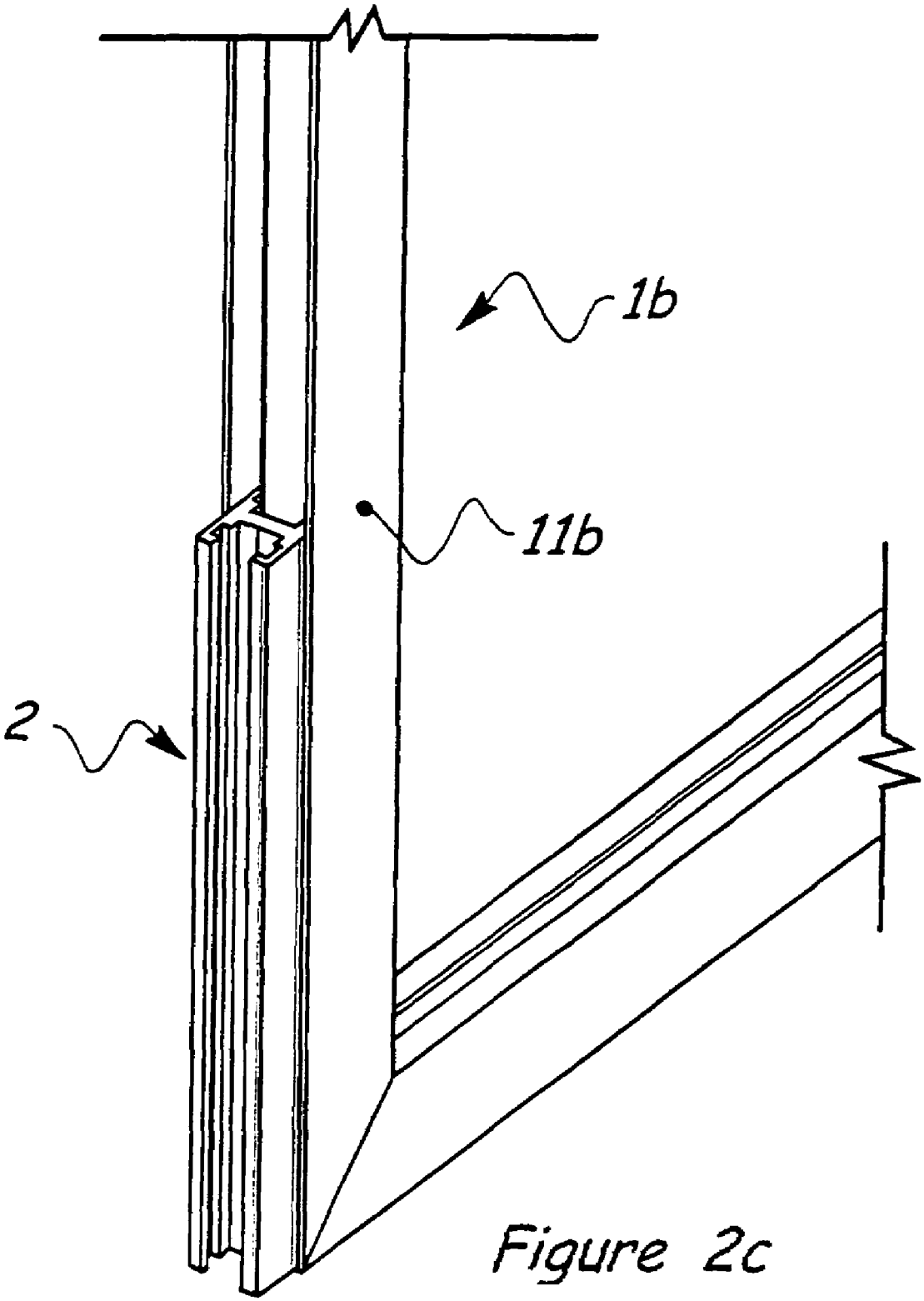
FIG. 2*c* shows a perspective view of the double lock of FIG. 2*a* being installed to the bottom section of a right frame.

The interlocking action of the double lock (2) has been previously disclosed in the earlier Malaysian Patent Application Number PI 20032116. In this present disclosure, a plurality of single locks (3) and double locks (2) of shorter length are taught. One double lock (2) is disposed towards the bottom section of the right frame element (11*b*) as seen in FIG. 2*c*.

Figure 3A:
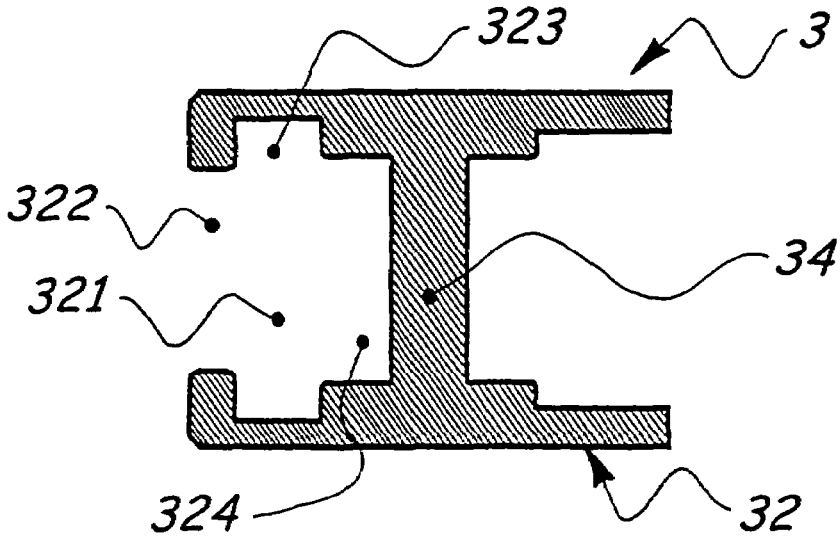
FIG. 3*a* shows a cross-section view of a single lock according to the invention.

FIG. 3*a* shows a cross-section view of the single lock (3) according to the invention. One specific design of the single lock (3) according to the present invention is shown. It is substantially an I-shaped channel with two lateral flanges (32) and a lengthwise web (34). The undersides on one similar side of the lateral flanges (32) are turned inwardly to form one lock slot (321) with the lengthwise web (34). Each lock slot (321) defines a narrow entrance (322), an enlarged interior section (323) and a recessed portion (324).

It is important to note that the single locks (3) are designed, such that they can be slid into the frame slots (12*a*) on one vertical frame element (11*a*). The undersides on the other similar side of the lateral flanges (32) are straightened, such that the lateral flanges (32) protrude into the frame slot (12*b*) of the adjacent frame element (11*b*). A resistance fit is formed, giving structural support to the assembly of two adjacent frames (1*a*, 1*b*).

Figure 3B:
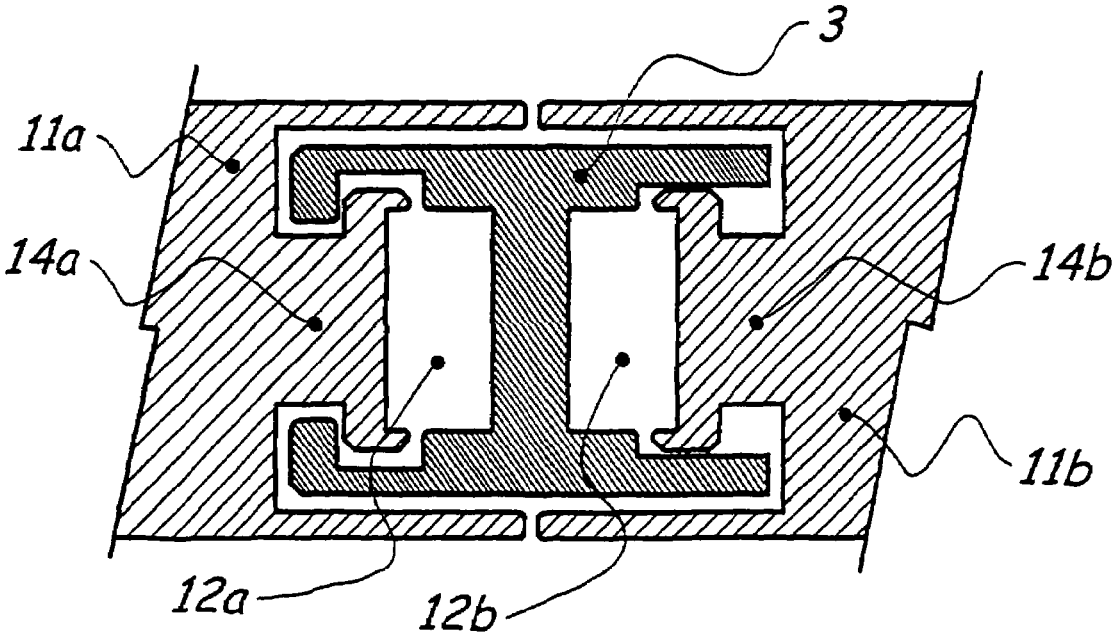
FIG. 3*b* shows a cross-section view indicating how the single lock of FIG. 3*a* being sandwiched between two frame slots of FIG. 1 of adjacent frame elements.

As seen in FIG. 3*b*, the single lock (3) is being sandwiched between two frame slots (12*a*, 12*b*) of adjacent vertical frame elements (11*a*, 11*b*), according to the invention.

Likewise, single locks (3) can be fitted into horizontal frame elements (11).

Figure 3C:
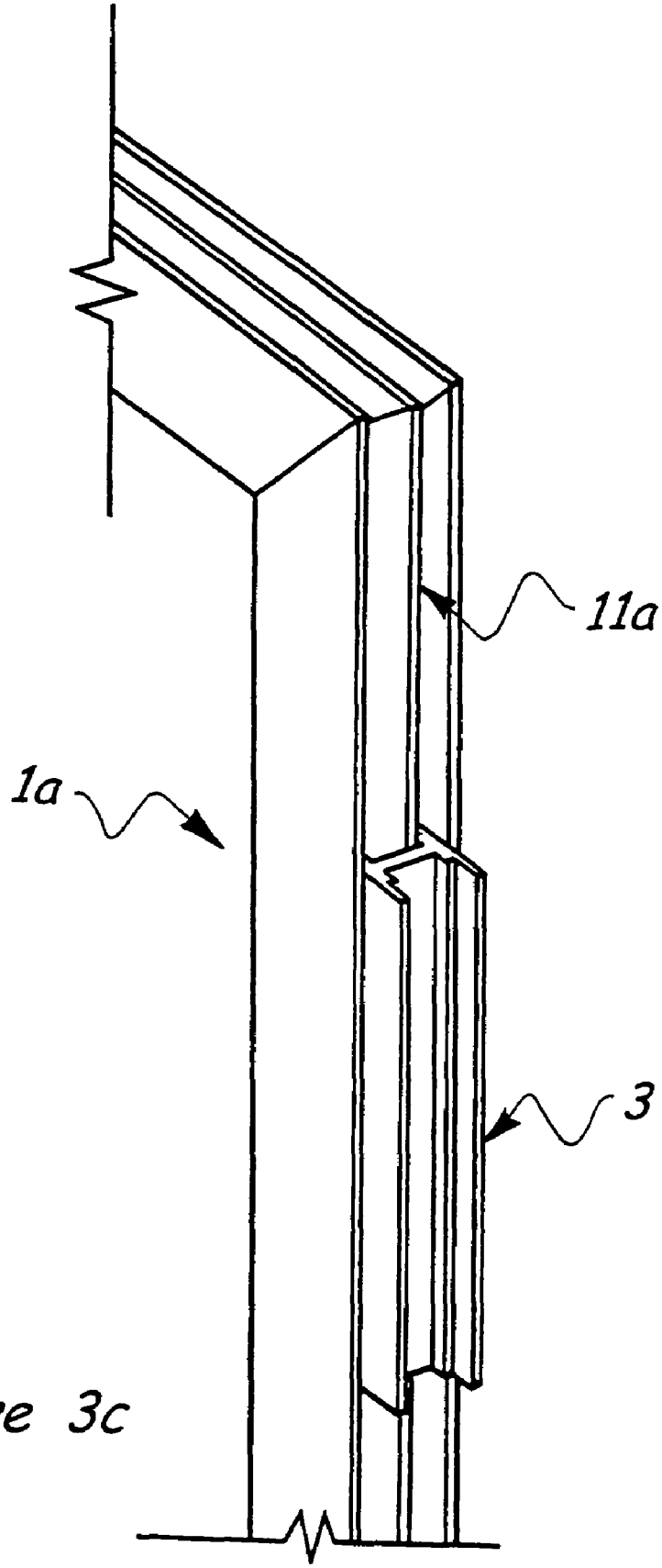
FIG. 3*c* shows a perspective view of one single lock of FIG. 3*a* being installed on the intermediate section of a left frame.

As seen in FIG. 3*c*, one single lock (3) is being placed at one intermediate position on a vertical frame element (11*a*), according to the invention. One side of the single lock (3) engages the frame element (11*a*) of the left frame (1*a*). The other side of the single lock (3) is left exposed to be inserted into the frame slot (12*b*) of the right vertical frame element (11*b*), without locking. This prevents lateral movement at the intermediate sections of the frame elements (11*a*, 11*b*).

The present invention therefore teaches a method of assembling two adjacent vertical frame elements (11*a*, 11*b*), using at least two double locks (2) and a plurality of intermediate single locks (3).

Figure 4A:
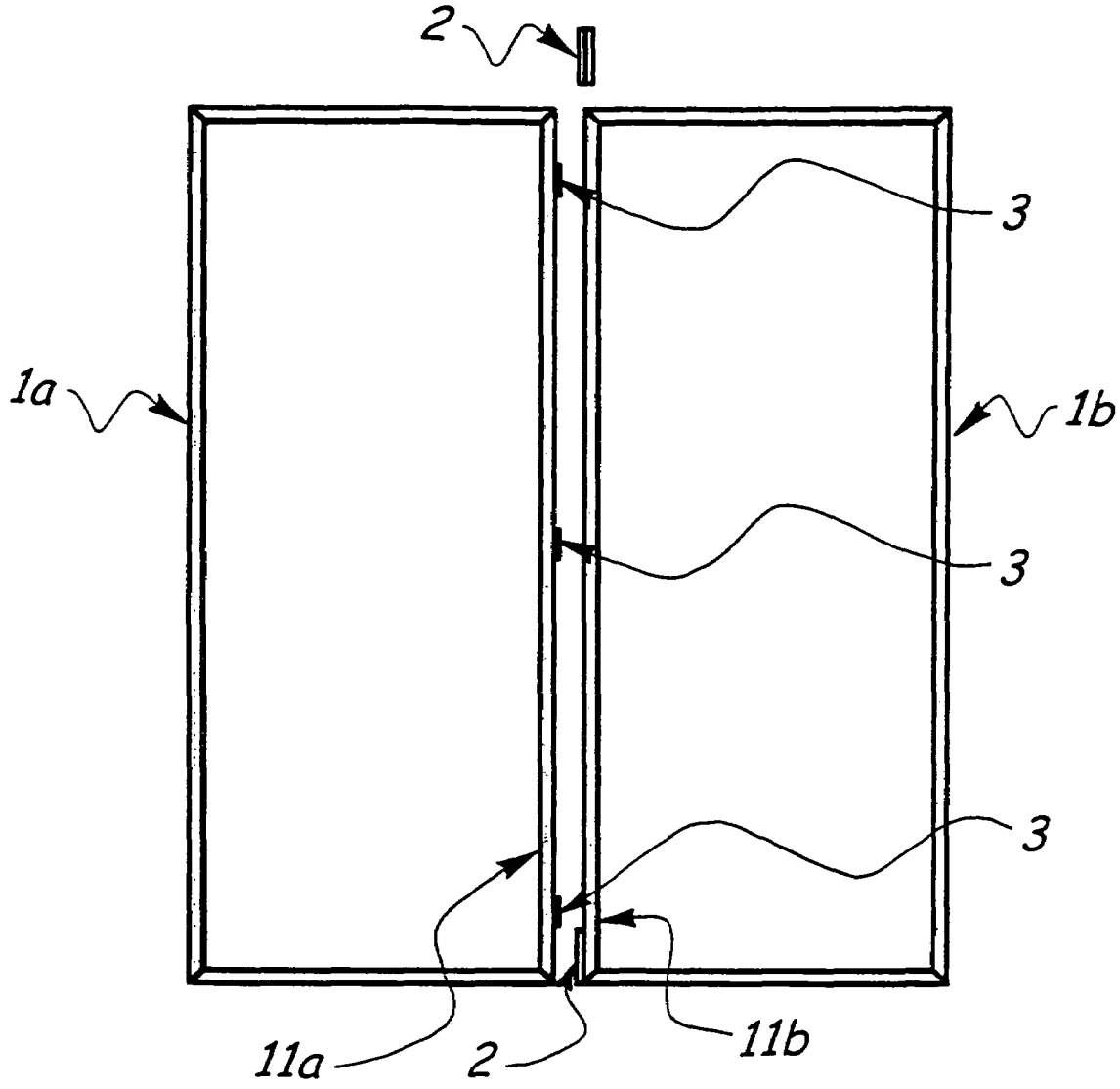
FIG. 4*a* shows a frontal view of two adjacent frames before assembly, with three single locks intermediately disposed, a bottomly disposed double lock and another double lock yet to be fitted from the top.

Before assembly, a double lock (2) is first installed to the bottom section of a right frame element (11*b*). Three single locks (3) are equidistantly installed along the length of the left frame element (11*a*). FIG. 4*a* shows a frontal view of the two adjacent frames (1*a*, 1*b*) before assembly, with three single locks (3) intermediately disposed on the left frame element (11*a*), and the double lock (2) at the bottom section of the right frame element (11*b*).

Figure 4B:
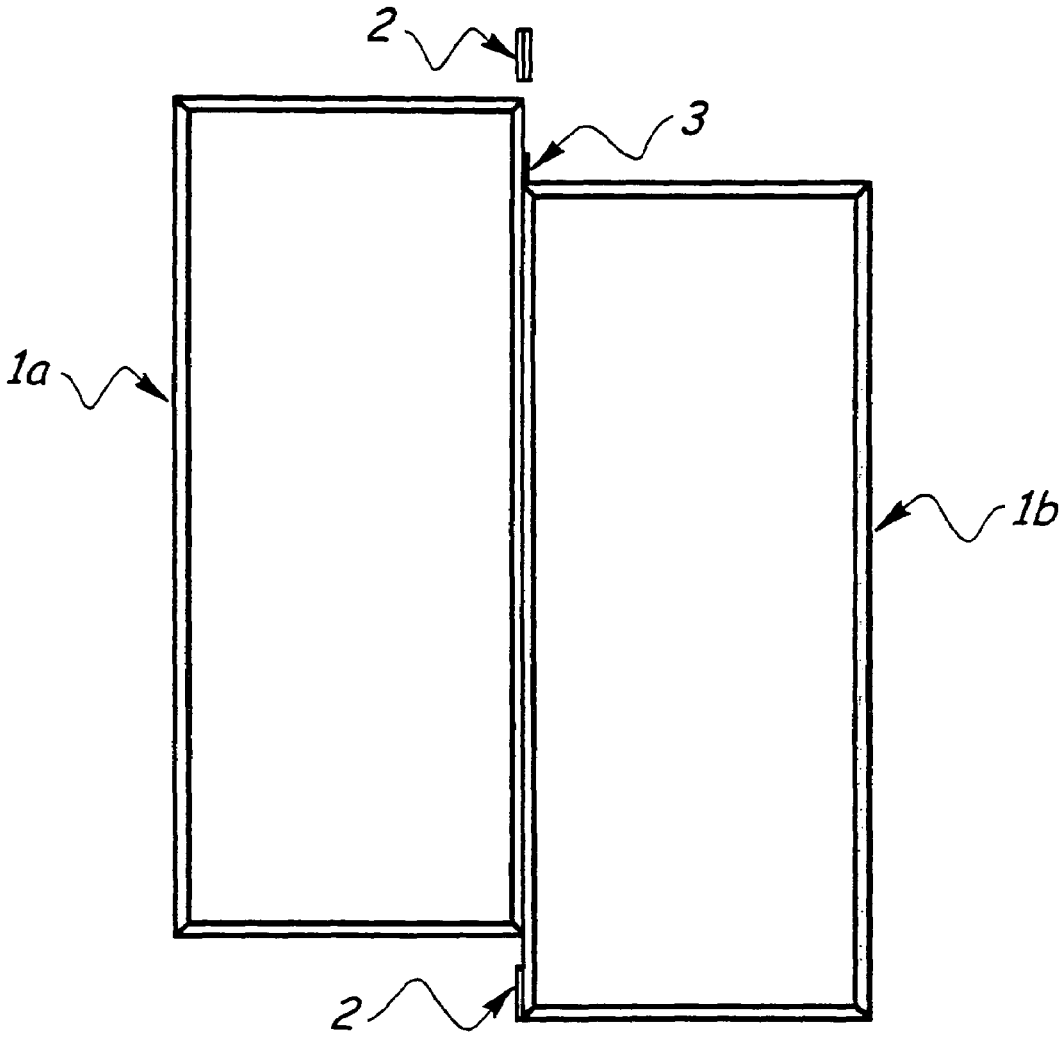
FIG. 4*b* shows a frontal view of two adjacent frames shown in FIG. 4*b*, in the process of being fitted together.
Figure 4C:
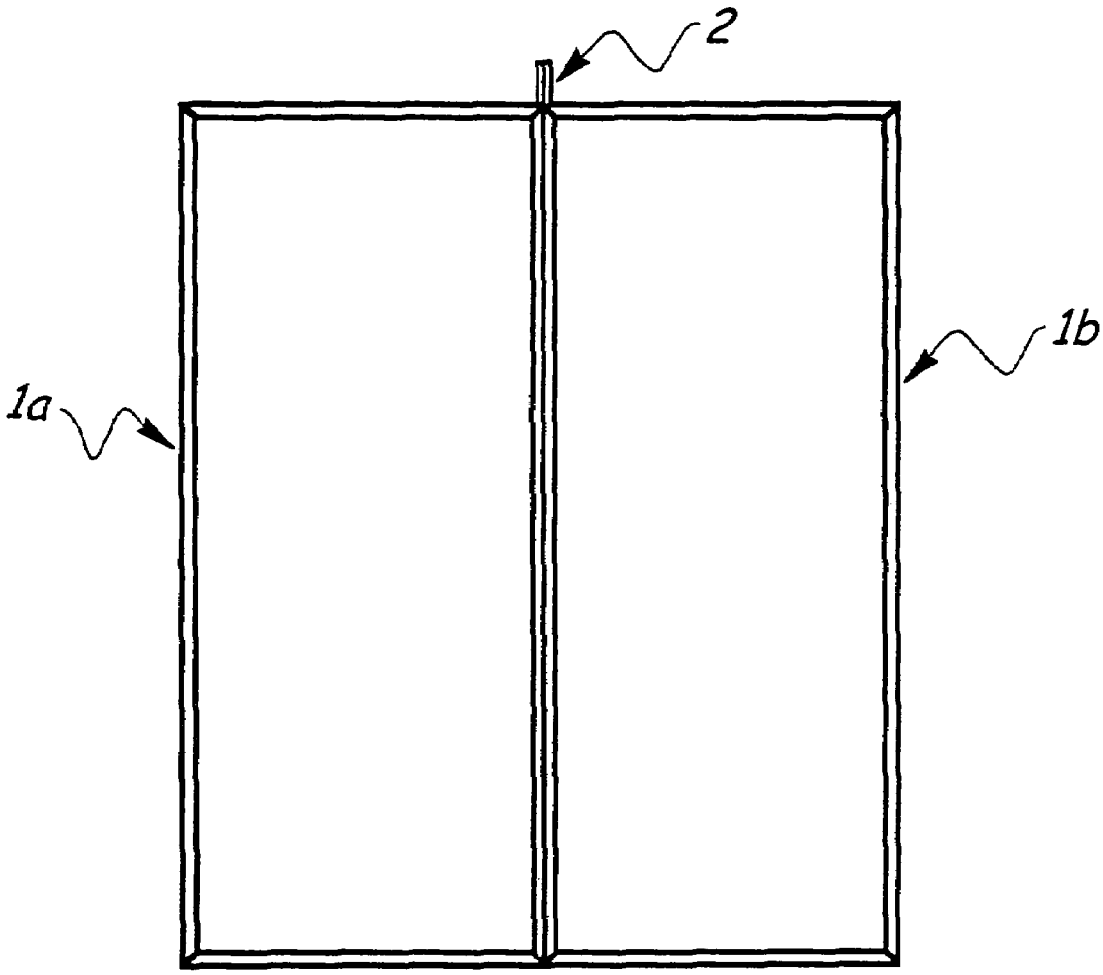
FIG. 4*c* shows a frontal view of two adjacent frames shown in FIG. 4*b*, as finally fitted by a top double lock.

To assemble the two frames (1*a*, 1*b*), three single locks (3) are first inserted into the frame slot (12*a*) of the left frame element (11*a*). One double lock (2) is also installed to the bottom section of the right frame element (11*b*), as shown in FIG. 4*a*. The left frame (1*a*) with the single locks is first inserted into the intermediate section of the right frame (1*b*) and then is slid to interlock the bottom double lock (2). To complete the assembly, one double lock (2) is slidably fitted in between the top sections of the two frames (1*a*, 1*b*). FIG. 4*b* shows a frontal view of these two adjacent frames (1*a*, 1*b*) in the process of being fitted together. FIG. 4*c* shows a frontal view of the two adjacent frames (1*a*, 1*b*) at the final stage of assembly.

The invention claimed is:

1. A method of constructing a modular framing system, including orthogonal frames arranged with corresponding edges positioned in close proximity to one another, each orthogonal frame being formed from two horizontal and two vertical frame elements, each frame element being equipped with a frame slot and a plurality of locks positioned between adjacent vertical frame elements, the method comprising the steps of:

providing a first and a second orthogonal frame each formed from two horizontal frame elements and two vertical frame elements, a first vertical frame element of the first orthogonal frame configured to be connected to a second vertical frame element of the second orthogonal frame;

providing a frame slot that includes a lock guide with an enlarged head placed inside a U-shaped channel of each vertical frame element;

providing a double lock at a bottom section of the first vertical frame element;

providing a plurality of single locks equi-distantly spaced along a length of the second vertical frame element;

inserting the second vertical frame element into an intermediate section of the first vertical frame element;

sliding one of the first and second vertical frame elements relative to one another to interlock the double lock fitted at the bottom section of the first vertical frame element; and interlocking top sections of the first and second vertical frame elements with another double lock.

2. A method of constructing a modular framing system as in claim 1 further comprising the steps of:

forming an I-shaped channel with two lateral flanges and a lengthwise web;

turning inwardly undersides on both sides of the lateral flanges to form two lock slots with the lengthwise web; and defining a narrow entrance, an enlarged interior section and a recessed portion in each lock slot, whereby the double locks are adapted to be slid into the frame slot on the frame elements and is adapted to interlock the first vertical frame element and second vertical frame element.

3. A method of constructing a modular framing system as in claim 1 further comprising the steps of:

forming an I-shaped channel with two lateral flanges and a lengthwise web;

turning undersides on a first similar side of the lateral flanges inwardly to form a single lock slot with the lengthwise web, defining a narrow entrance, an enlarged interior section and a recessed portion such that the single lock slot is adapted to be slid into the frame slot of either of the first or second vertical frame elements; and straightening undersides on a second similar side of the lateral flanges, such that the undersides protrude into the frame slot of an adjacent frame element, whereby the single lock forms a resistance fit and prevents lateral movement of the intermediate sections of the first and second vertical frame elements frames.

4. A method of constructing a modular framing system as in claim 3 further comprising the steps of:

providing a frame slot that includes integrally a lock guide with an enlarged head placed inside a U-shaped channel of each horizontal frame element;

providing a plurality of single locks equi-distantly spaced along a length of a horizontal frame element; and inserting the horizontal frame element fitted with single locks into an adjacent horizontal frame element.

* * * * *

UNITED STATES PATENT AND TRADEMARK OFFICE

CERTIFICATE OF CORRECTION

PATENT NO. : 7,418,805 B2
APPLICATION NO. : 11/185309
DATED : September 2, 2008
INVENTOR(S) : Chee Peng Tan It is certified that error appears in the above-identified patent and that said Letters Patent is hereby corrected as shown below:

On the Title Page, item (73) Assignee, "Lumper" should read --Lumpur--

Column 3, line 2, "4b" should read --4a--

Column 3, line 4, "4b" should read --4a--

Column 3, line 47, the first instance of "14b" should read --14a--

Signed and Sealed this

Ninth Day of December, 2008

JON W. DUDAS
*Director of the United States Patent and Trademark Office*